US006366032B1

(12) United States Patent
Allison et al.

(10) Patent No.: US 6,366,032 B1
(45) **Date of Patent: *Apr. 2, 2002**

(54) FLUORESCENT LAMP BALLAST WITH INTEGRATED CIRCUIT

(75) Inventors: Joseph M. Allison, Euclid, OH (US); David J. Moore, St. John, IN (US)

(73) Assignee: Robertson Worldwide, Inc., Blue Island, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/494,193

(22) Filed: Jan. 28, 2000

(51) Int. Cl.[7] ..... G05F 1/00
(52) U.S. Cl. ..... 315/307; 315/219; 315/224
(58) Field of Search ..... 315/219, 224, 315/225, 244, 247, 209 R, 291, 307, 360

(56) References Cited

U.S. PATENT DOCUMENTS

| | | | | |
|---|---|---|---|---|
| 4,495,446 A | | 1/1985 | Brown et al. | 315/206 |
| 4,667,131 A | | 5/1987 | Nilssen | 315/275 |
| 4,710,682 A | | 12/1987 | Zuchtriegel | 315/224 |
| 5,015,923 A | | 5/1991 | Nilssen | 315/307 |
| 5,111,118 A | | 5/1992 | Fellows et al. | 315/307 |
| 5,130,611 A | | 7/1992 | Johns | 315/224 |
| 5,225,742 A | | 7/1993 | Beasley | 315/307 |
| 5,315,214 A | | 5/1994 | Lesea | 315/209 R |
| 5,436,529 A | | 7/1995 | Bobel | 315/127 |
| 5,479,076 A | | 12/1995 | Moberg | 315/307 |
| 5,493,180 A | | 2/1996 | Bezdon et al. | 315/91 |
| 5,546,300 A | | 8/1996 | Lee et al. | 315/209 R |
| 5,550,436 A | | 8/1996 | Houk | 315/209 R |
| 5,559,394 A | | 9/1996 | Wood | 315/224 |
| 5,574,336 A | | 11/1996 | Konopka et al. | 315/225 |
| 5,636,111 A | | 6/1997 | Griffin et al. | 315/225 |
| 5,691,605 A | | 11/1997 | Xia et al. | 315/307 |
| 5,705,894 A | | 1/1998 | Krummel | 315/119 |
| 5,729,096 A | | 3/1998 | Liu et al. | 315/225 |
| 5,739,645 A | * | 4/1998 | Xia et al. | 315/307 |
| 5,747,943 A | | 5/1998 | Houk et al. | 315/225 |
| 5,757,141 A | | 5/1998 | Wood | 315/224 |
| 5,770,925 A | | 6/1998 | Konopka et al. | 315/225 |
| 5,808,422 A | | 9/1998 | Venkitasubrahmanian et al. | 315/225 |
| 5,854,538 A | | 12/1998 | Krummel | 315/105 |

(List continued on next page.)

*Primary Examiner*—David Vu
*Assistant Examiner*—Wilson Lee
(74) *Attorney, Agent, or Firm*—Charles E. Bruzga

(57) ABSTRACT

A resonant fluorescent lamp ballast includes an IC driver for a half-bridge arrangement that supplies AC current to a lamp. The IC creates a frequency sweep from a pre-heat frequency, through a resonant frequency, to a still lower operating frequency. A pre-heat pin in the IC triggers a re-start or the frequency sweep when a first signal exceeds a first threshold level. A shut-down pin in the IC associated with an internal shut-down latch shuts down the driver when a second signal exceeds a second threshold level. Pre-heat trigger circuitry detects a current spike through half-bridge switches when the lamp has not yet started, supplying the pre-heat pin with a first signal exceeding the first threshold level. End-of-life circuitry provides to the shut-down pin a second signal exceeding the second threshold level if lamp current fails to reach a substantial portion of its normal level within a predetermined time. A DC current-supply path is provided from a DC current supply, through at least one filament of each lamp in the load circuit, to a power-supply pin for the IC. The end-of-life circuitry cooperates with the pre-heat trigger circuitry by limiting the number of the frequency sweeps to no more than occur during the predetermined time set by the end-of-life circuitry. The DC path cooperates with the end-of-life circuitry and the internal shut-down latch to reset the latch when the DC path is broken due to absence of the at least one filament in the path.

13 Claims, 2 Drawing Sheets

U.S. PATENT DOCUMENTS

| | | | | | |
|---|---|---|---|---|---|
| 5,872,429 | A | | 2/1999 | Xia et al. | 315/194 |
| 5,925,990 | A | | 7/1999 | Crouse et al. | 315/307 |
| 5,932,974 | A | | 8/1999 | Wood | 315/119 |
| 5,932,976 | A | | 8/1999 | Maheshwari et al. | 315/291 |
| 5,936,357 | A | | 8/1999 | Crouse et al. | 315/247 |
| 5,945,788 | A | | 8/1999 | Li et al. | 315/308 |
| 5,969,483 | A | | 10/1999 | Li et al. | 315/225 |
| 5,973,455 | A | | 10/1999 | Mirskly et al. | 315/105 |
| 5,982,113 | A | | 11/1999 | Crouse et al. | 315/291 |
| 6,005,354 | A | | 12/1999 | Houk et al. | 315/225 |
| 6,008,592 | A | * | 12/1999 | Ribarich | 315/307 |
| 6,008,593 | A | * | 12/1999 | Ribarich | 315/224 |
| 6,011,358 | A | * | 1/2000 | Knobloch et al. | 315/224 |
| 6,011,360 | A | | 1/2000 | Gradzki et al. | 315/244 |
| 6,150,773 | A | * | 11/2000 | Ribarich et al. | 315/291 |

* cited by examiner

FLUORESCENT LAMP BALLAST WITH INTEGRATED CIRCUIT

FIELD OF THE INVENTION

This invention relates to fluorescent lamp ballasts incorporating an integrated circuit. More particularly, the invention relates to such ballasts including circuitry in addition to the integrated circuit for implementing the functions of end-of-lamp life shutdown, automatic resetting of the ballast when a lamp is replaced, and limiting the number of attempts to start the lamp.

BACKGROUND OF THE INVENTION

Ballasts, or power-supply, circuits for fluorescent lamps can benefit from incorporating various circuit functions in integrated circuit (IC) form. IC's can include a driver for a halfbridge switching arrangement that provides AC power for the lamp. Proprietary IC's typically also include the following, generally-stated functions: (1) end-of-lamp life shutdown; (2) automatic resetting of the ballast when a lamp is replaced, and (3) limiting the number of attempts to start the lamp.

Proprietary IC's, however, are often not available to a ballast manufacturer. On the other hand, ballast manufacturers can obtain widely used, low cost IC's incorporating various functions including a half-bridge switching arrangement, but lacking the foregoing three functions. It would be desirable if additional circuitry could be provided to enable the foregoing three functions in conjunction with such low cost IC's. It would further be desirable if such additional circuitry could be implemented economically.

SUMMARY OF THE INVENTION

In a preferred form, the invention provides a fluorescent lamp ballast, comprising a load circuit for at least one lamp that includes an inductance and capacitance for setting a resonant frequency of the circuit. A half-bridge switching arrangement supplies AC current to the load. An integrated circuit comprises a driver for the half-bridge arrangement including control means to create a frequency sweep from a pre-heat frequency, through a substantially lower, resonant frequency, to a still lower operating frequency. A pre-heat pin in the IC triggers the control means to re-start a frequency sweep in response to a first signal exceeding a first threshold level. A shut-down pin in the IC, associated with an internal shut-down latch, shuts down the driver in response to a second signal exceeding a second threshold level. A power-supply pin in the IC provides power to the integrated circuit.

When the ballast is powered-up, the integrated circuit starts a frequency sweep at the pre-heat frequency, substantially above the resonant frequency of the output network, where the voltage across the lamp is below the ignition voltage. The integrated circuit holds the frequency fixed for about 1 second, allowing the lamp filaments time enough to heat prior to ignition. The integrated circuit then drops the frequency relatively rapidly down to the operating frequency, passing through the resonant frequency. In normal operation, the lamp ignites in response to the resonant build-up of voltage. However, if the lamp fails to ignite, the half-bridge switches experience potentially destructive current spikes, caused by operation with no resistive load below resonance. This stressful situation is immediately corrected by pre-heat trigger circuitry that detects the current spikes through switches of the half-bridge switching arrangement and, in response, supplies the pre-heat pin with a first signal exceeding the first threshold level. This triggers the integrated circuit into a new frequency sweepor start-up sequenceommencing with a pre-heat mode, where the frequency is once again above resonance for a dwell time of about 1 second, followed by a frequency drop. This cycle of lamp ignition attempts could continue indefinitely, if not for the end-of-lamp life circuitry. End-of-lamp life circuitry provides to the shut-down pin a second signal exceeding the second threshold level if lamp current fails to reach a substantial portion of its normal level within a predetermined period of time. A DC current-supply path is provided from a DC current supply, through at least one filament of each lamp in the load circuit, to the power-supply pin of the integrated circuit.

The end-of-lamp life circuitry cooperates with the pre-heat trigger circuitry by limiting the number of frequency sweeps and hence lamp ignition attempts-to no more than occur during the predetermined period of time set by the end-of-lamp life circuitry. Limiting the lamp ignition attempts is desirable from the user's point of view. Each ignition attempt can be accompanied by a flash of light from a defective lamp. If ignition attempts were not limited, the persistent flashes of light could be annoying to the user.

The DC path cooperates with the end-of-life circuitry and the internal shut-down latch to reset the latch when the DC path is broken due to absence of at least one filament in the path. The latch resets when a lamp is removed for replacement with a new lamp. The reset of the latch when a lamp is removed is an important operational feature because, otherwise, the primary power must be removed momentarily to reset the latch, thereby enabling a new lamp to start. Removal of primary power, even momentarily, is inconvenient to the user.

The foregoing ballast provides circuitry in addition to widely used IC's for providing the functions of: (1) end-of-lamp life shutdown; (2) automatic resetting of the ballast when a lamp is replaced; and (3) a limitation on with the number of attempts to start the lamp. In preferred embodiments, such functions can be implemented especially economically due to cooperation between circuit functions.

DETAILED DESCRIPTION OF THE INVENTION

Figure 1:
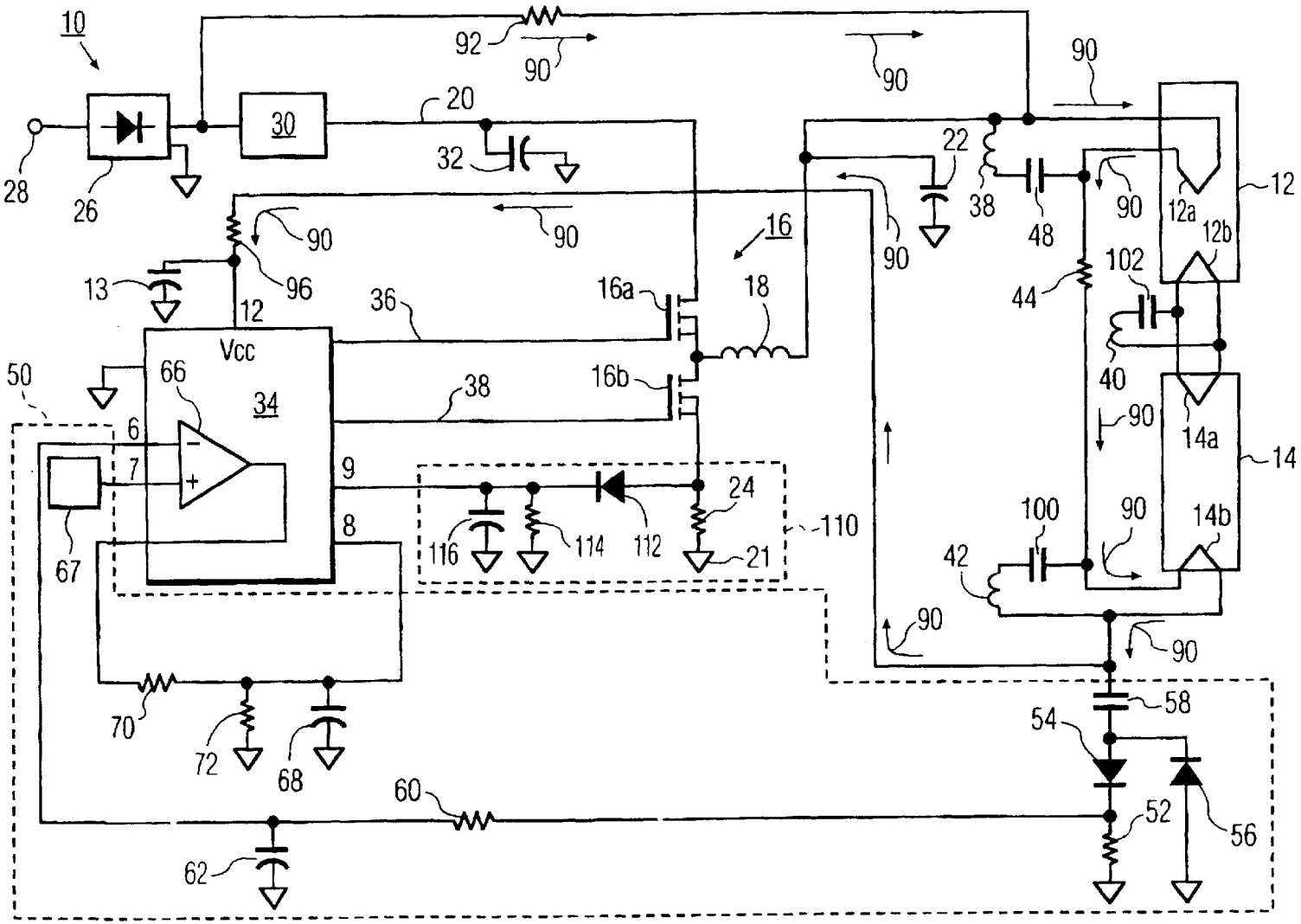
FIG. 1 is a schematic diagram, partially in block form, of a ballast for a fluorescent lamp in accordance with the invention.

FIG. 1 shows a ballast 10 for fluorescent lamps 12 and 14. The ballast 10 includes a half-bridge switching arrangement 16 including upper and lower switches 16*a* and 16*b*. As known in the art, switches 16*a* and 16*b* alternately conduct current. When switch 16*a* conducts, it connects a resonant inductor 18 of the load circuit to a DC link 20. When switch 16*b* conducts, it connects inductor 18 to ground 21 via a low impedance resistor 24.

The load circuit further includes the lamp, circuitry for pre-heating filaments 12*a*, 12*b*, 14*a* and 14*b* of the lamps, and a resonant capacitor 22. The DC link 20 is supplied with DC current by a bridge rectifier 26 receiving AC power at input 28, and preferably, a power factor correction circuit 30. A capacitor 32 smoothes the voltage on the DC link.

In accordance with an aspect of the invention, ballast 10 includes an integrated circuit (IC) 34 providing various functions, which preferably include:

(1) A driver for half-bridge arrangement 16, with appropriate voltage-level shifting for controlling a gate, or control electrode, 36 of switch 16*a*, and for controlling gate 38 of switch 16*b*.

Figure 2:
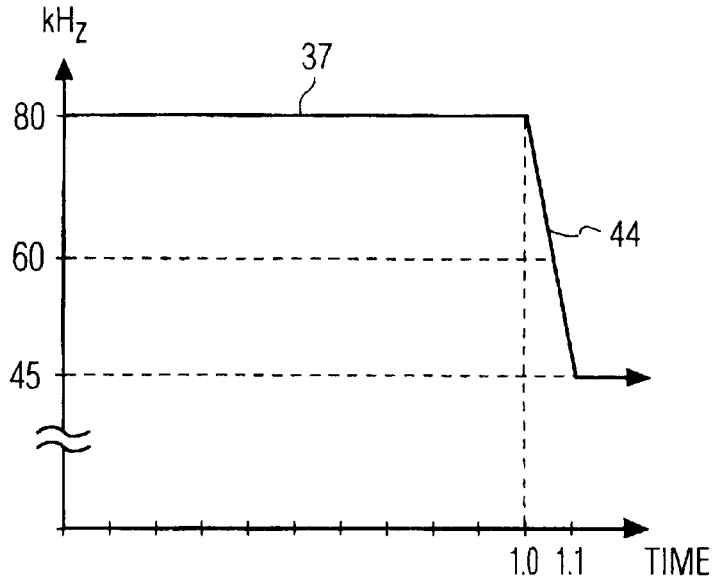
FIG. 2 shows frequency-versus-time curve of a typical frequency sweep used in the ballast of FIG. 1.

(2) Means to alternately turn-on switches 16*a* and 16*b* with a frequency sweep such as shown in FIG. 2. As shown in that figure, the sweep starts at a pre-heat frequency of 80 kHz, for instance, for a duration such as 1.0 second as shown by curve segment 37. During such segment, the lamp filaments are heated by current in windings 38, 40 and 42, which may be tapped off resonant inductor 18. During subsequent segment 44, in the interval from 1.0 to 1.1 seconds, for instance, the frequency drops substantially from the pre-heat frequency, through a resonant frequency of 60 kHz, for instance, to a still lower frequency of 45 kHz, for instance, at which the lamps can operate.

(3) Means to trigger the foregoing means to re-start a frequency sweep in response to a first signal exceeding a first threshold level, preferably only momentarily, on pin 9 of the IC.

(4) Means for shutting down the function of driving the half-bridge arrangement through an internal shut-down latch (not shown) contained in the IC and activated in response to a second signal exceeding a second threshold level, preferably only momentarily, on shutdown pin 8 of the IC.

IC 34 also includes a power-supply pin 12 for powering the chip. A capacitor 13 is connected from pin 12 to ground. The ballast can provide these functions especially economically where it comprises a widely used IC such as chip no. L6574 manufactured by ST Microelectronics of Italy.

In accordance with an aspect of the invention, additional circuitry is provided to supplement IC 34 for implementing the functions of end-of-lamp life shut down, automatic resetting of the ballast when a lamp is replaced, and limiting the number of attempts to start the lamp. These functions are preferably implemented in a cooperative fashion to minimize the complexity and cost of the additional circuitry.

END-OF-LAMP LIFE SHUTDOWN

End-of-lamp life circuitry 50 cooperates with the IC and a DC path 90, described below, to shut down the IC and keep it shut down until the DC path is broken by either removing the lamp or shutting off the main power. In circuitry 50, a shunt resistor 52 is used to sense lamp current. Diodes 54 and 56 rectify lamp current so that resistor 52 senses halfwave rectified current. Capacitor 58 blocks DC current and prevents the lamp from having a DC component of arc current. Resistor 60 and capacitor 62 smooth the sensed lamp current and apply it to an inverting input of an operational amplifier 66, which is preferably contained within IC 34. A reference voltage is provided by means 67 to the non-inverting input of the operational amplifier, and may represent a substantial portion of normal lamp current, such as between about 30 and 70 percent, e.g. 50 percent.

Figure 3:
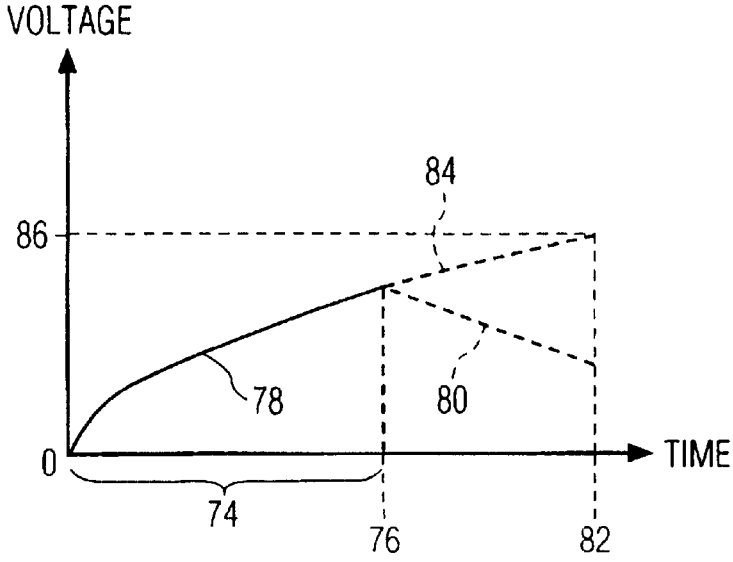
FIG. 3 shows voltage-versus-time sweep to illustrate operation of end-of-life circuitry used in the present invention.

After power-up of the IC, lamp current is low, making the output of operational amplifier 66 high, whereby capacitor 68 starts charging through resistor 70. The capacitor voltage is applied to pin 8 input of the IC. This pin applies the capacitor voltage to a shutdown latch (not shown) inside the IC having a threshold level. If the voltage on the capacitor reaches the threshold level, the latch will be set and the ballast will be shut down until reset. The time required for the capacitor voltage to reach that threshold level is typically 6 seconds, as determined by the time constant of capacitor 68 and resistors 70 and 72. If the lamp ignites before the threshold level is reached, then the output of operational amplifier 66 switches low and the capacitor discharges to zero. FIG. 3 shows the voltage on capacitor 68 as a function of time. During time interval 74, charging of capacitor 68 is indicated by a solid line 78. At time 76, for instance, lamp current exceeds a threshold level of 50 percent, for example, whereby the output of operational amplifier 66 switches low. Capacitor 68 then discharges as indicated by dashed-line curve 80. If, however, lamp current does not reach the threshold level by time 82 (e.g., 6 seconds), the voltage 84 on the capacitor reaches threshold level 86, and the internal shut-down latch in the IC is triggered to shut down the ballast. The latch is held in the shutdown state by the current in DC path 90 comprising lamp filaments 12*a*, 14*b* and resistors 92, 44 and 96.

AUTOMATIC RELAMP RESET

It is desirable that the act of replacing a lamp automatically resets the ballast from the shut-down state. There should be no need to turn off AC power momentarily at node 28 to reset a shut-down latch. Such re-lamp, reset function can be carried out by providing DC path 90 from a DC source, such as bridge rectifier 26, to power-supply pin 12 of the IC, via at least one filament of each lamp. Resistors 92, 44 and 96 limit the current in DC path 90. Resistor 94 may typically be implemented as a series of surface-mount resistors (not shown) with appropriate capability to withstand the voltage across the lamps. Capacitors 98 and 100 associated with filament 12*a* and 14*b*, respectively, block DC current from flowing through associated findings 38 and 42, so as to maintain the integrity of DC path 90.

In operation, removing a lamp necessarily breaks DC path 90 to IC power-supply pin 12. By removing power to pin 12, the internal shut-down latch (not shown) in the IC, associated with end-of-life circuitry 50, resets. When a new lamp replaces a failed lamp, a filament of the new lamp completes DC path 90. As a result, IC 34 commences driving the half-bridge arrangement 16 to start the lamps. Thus, DC path 90 cooperates with end-of-life circuitry 50 and the internal shut-down latch to reset the latch when the DC path is broken.

LIMITATIONS ON THE NUMBER OF ATTEMPS TO START A LAMP

Circuitry 110 senses when a lamp has failed to start and provides a momentary signal to pin 9 of IC 34, which triggers the IC to restart a frequency sweep such as shown in FIG. 2. Shunt resistor 24 senses current spikes through switches 16*a* and 16*b* that occur when a lamp has failed to start. Such current spikes can burn out the switches if allowed to continue indefinitely. Diode 112 in combination with resistor 114 and capacitor 116 convert the narrow spikes into a continuous voltage, thereby assuring an adequate signal to pin 9. Such voltage exceeds a threshold level for triggering the IC to restart a frequency sweep when current spikes occur.

Circuitry 110 may thus be referred to as pre-heat trigger circuitry since the beginning of the frequency sweep starts at a pre-heat frequency. Such pre-heat trigger circuitry 110 cooperates with end-of-life circuitry 50 to limit the number of attempts to start a lamp. End-of-life circuitry 50 allows pre-heat trigger circuitry 110 to repetitively cause frequency sweeps, when a lamp has not started, only as long as the predetermined period of time set by circuitry 50, for instance, 6 seconds. Once such predetermined period of time has elapsed, end-of-life circuitry 50 shuts down the IC.

Beneficially, in addition to the IC, inexpensive resistors, capacitors and diodes can implement the above-described functions of end-of-lamp life shut down, automatic resetting of the ballast when a lamp is replaced, and limiting the number of attempts to start the lamp. In this connection, reference voltage means 67 can comprise a reference voltage source (not shown) built into IC 34 of 2 volts, for instance, provided on a pin (not shown) and a tworesistor voltage-divider (not shown) with the upper resistor of 62 K ohms and the lower resistor 5.62 ohms. As such, only inexpensive resistors can be used to implement reference voltage means 67.

Exemplary component values for the circuit of FIG. 1 are as follows for fluorescent lamps 12 and 14 rated at 26-watts each, with a voltage on DC link 20 of 470 volts; and with pre-heat, resonant and operating frequencies of 87 kHz, 57 kHz, and 45 kHz, respectively.

Capacitor 13: 0.47 microfarads.

Switches 16*a* and 16*b* may each be of type 3NB50, n-channel, enhancement mode MOSFET, sold by ST Microelectronics, an international company.

Resonant inductor 18: 2.6 millihenries.

Resistor 24: 2.7 ohms.

Filaments 12*a*, 12*b*, 14*a* and 14*b*: 2 ohms each.

Resonant capacitor 22: 3.3 nanofarads.

Capacitor 32: 11 microfarads.

Integrated circuit 34: the specific chip identified above.

Winding 38, having a turns ratio with inductor 18 of 7-to 230.

Winding 40, having a turns ratio with inductor 18 of 9-to 230.

Winding 42, having a turns a ratio with inductor 18 of 7-to 230.

Resistor 52: 2.7 ohms.

Capacitor 58: 0.1 microfarads.

Resistor 60: 10 k ohms.

Capacitor 62: 0.1 microfarads.

Voltage-reference means 67 generating voltage representing 50 percent of normal lamp current of 0.15 amps.

Capacitor 68: 100 microfarads.

Resistor 70: 332 k ohms.

Resistor 72 to 82 k ohms.

Resistor 92: 200k ohms.

Resistor 94: 100 k ohms.

Resistor 96: 100 k ohms.

Capacitor 98: 0.1 microfarads.

Capacitor 100: 0.1 microfarads.

Capacitor 102: 0.15 microfarads.

Resistor 114. 1.0 k ohms.

Capacitor 116: 0.022 microfarads.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A fluorescent lamp ballast, comprising:

a) a load circuit for at least one lamp, including a resonant inductance and a resonant capacitance for setting a resonant frequency of the circuit;

b) a half-bridge switching arrangement for supplying AC current to the load, c) an integrated circuit comprising:

i) a driver for the half-bridge arrangement including control means to create a frequency sweep from a pre-heat frequency, through a substantially lower, resonant frequency, to a still lower operating frequency;

ii) a pre-heat pin for triggering the control means to re-start a frequency sweep in response to a first signal exceeding a first threshold level, iii) a shut-down pin associated with an internal shut-down latch for shutting down the driver in response to a second signal exceeding a second threshold level; and iv) a power-supply pin for power the integrated circuit; and d) pre-heat trigger circuitry to detect a current spike through switches of the half-bridge switching arrangement when the lamp has not yet started and, in response, to supply the pre-heat pin with a first signs exceeding the first threshold level;

e) end-of-life circuitry for providing to the shut-down pin a second signal exceeding the second threshold level if lamp current fails to reach a substantial portion of its normal level within a predetermined period of time; and f) a DC current-supply path from a DC current supply, through at least one filament of each lamp in the load circuit, to the power-supply pin;

g) the end-of-life circuitry cooperating with the pre-heat trigger circuitry by limiting the number of the frequency sweeps to no more than occur during the predetermined period of time set by the end-of-life circuitry; and h) the DC current-supply path cooperating with the end-of-life circuitry and the internal shut-down latch to reset the latch when the DC current-supply path is broken due to absence of the at least one filament in the path.

2. The ballast of claim 1, wherein:

a) the substantial portion is between about 30 and 70 percent of normal level; and b) the predetermined period of time is below 10 seconds.

3. The ballast of claim 1, wherein the end the end-of-life circuitry comprises:

a) means to produce a DC signal representing magnitude of lamp current; and b) means, responsive to the DC signal, for providing a second signal to the shut-down pin if lamp current fails to reach a substantial portion of its normal level within a predetermined period of time.

4. The ballast of claim 3, wherein:

a) the integrated circuit includes an operational amplifier having first and second inputs; and b) the means for providing a second signal includes:

i) the operational amplifier with a first input receiving a reference voltage and a second input receiving the DC signal; the operational amplifier producing an acceptable current level signal when the DC signal exceeds the reference voltage and producing a non-acceptable current level signal when the DC signal is below the reference voltage; and ii) means, responsive to the output of the operational amplifier, for applying a shut-down signal to the shut-down pin after the predetermined period of time in the absence of the operational amplifier producing an acceptable current level signal.

5. A lamp ballast, comprising:

a) a load circuit including at least one lamp;

b) a switching arrangement for supplying AC current to the load;

c) an integrated circuit having a power-supply pin for powering the integrated circuit;

d) a DC current-supply path, comprising at least one nodes from a DC current supply, through at least one filament of at least one lamp in the load circuit, to the power-supply pin, in which every intervening node of said path is at a higher DC potential than that of the power-supply pin.

6. The ballast of claim 5, wherein the DC current-supply path is through at least one filament of each lamp in the load circuit.

7. The ballast of claim 5, wherein the load circuit includes a resonant inductance and a resonant capacitance for setting a resonant frequency of the circuit.

8. The ballast of claim 7, wherein the switching arrangement comprises a half-bridge arrangement.

9. The ballast of claim 5, wherein the integrated circuit includes a driver for the switching arrangement.

10. A lamp ballast, comprising:

a) a load circuit including at least one lamp;

b) an integrated circuit comprising:

i) a driver for supplying current to the load circuit; and ii) a power-supply pin for pow the integrated circuit; and c) a DC current-supply path, comprising at least one node, from a DC current, through at least one filament of at least one lamp in the load circuit, to the power-supply pin, in which every intervening node of aid path is at a higher DC potential than that of the power-supply pin.

11. The ballast of claim 10, wherein the DC current-supply path is through at least one filament of each lamp in the load circuit.

12. The ballast of claim 10, wherein the load circuit includes a resonant inductance and a resonant capacitance for setting a resonant frequency of the circuit.

13. The ballast of lcaim 12, wherein the switching arrangement comprises a half-bridge arrangement.

* * * * *